United States Patent [19]

Burns et al.

[11] Patent Number: 4,856,132

[45] Date of Patent: Aug. 15, 1989

[54] UTILITY GOLF TOOL

[76] Inventors: Walter T. Burns; Nancy H. Burns, both of 1142 E. Main St., Meriden, Conn. 06450

[21] Appl. No.: 215,274

[22] Filed: Jul. 5, 1988

[51] Int. Cl.[4] ..... B25F 1/04

[52] U.S. Cl. ..... 7/118; 7/114; 7/158; 7/168

[58] Field of Search ..... 7/118, 114, 158, 168, 7/167, 170; 15/105, 111, 112, 160, 161, DIG. 5, 159 A, 186, 187, 188; 30/151, 152, 155; 132/75.3, 75.4, 75.6, 76.4; 273/32 B, 32 A; 172/371, 373, 375

[56] References Cited

U.S. PATENT DOCUMENTS

| | | | |
|---|---|---|---|
| 1,187,842 | 6/1916 | Kaas | 30/152 |
| 1,398,583 | 11/1921 | Bovee | 30/155 |
| 3,105,257 | 10/1963 | Blagden | 15/105 |
| 3,136,547 | 6/1964 | Schaper | 273/32 A |
| 3,364,508 | 1/1968 | Garrett | 7/168 |
| 4,724,569 | 2/1988 | Eguchi et al. | 15/DIG. 5 |

FOREIGN PATENT DOCUMENTS

| | | | |
|---|---|---|---|
| 435945 | 10/1926 | Fed. Rep. of Germany | 30/152 |

*Primary Examiner*—Roscoe V. Parker
*Attorney, Agent, or Firm*—Leon Gilden

[57] ABSTRACT

A utility golf tool is set forth including a case with a plurality of spaced planar members integrally secured together by a medial interfitting integral rib to define an upper and lower compartment. The upper compartment includes a conventional cutting blade and an associated file blade. The lower compartment includes a divot repair tool and a golf cleaning brush comprising a plural series of rows of bristles of alternating height including spherical ends to minimize damage during a cleaning operation to a golf club, golf ball, and the like. A magnetic ball marker is received within a complementary recess within one of said planar member's outer surfaces for selective use.

1 Claim, 1 Drawing Sheet

10
20
21
12a
16
11
14
18
13a
12
15
13
29
22
19
23
26
25

20
14
18
15
12
13
19
22

20
18
30
29
15
12
13
19
23

20
16
12a
15
24
24
12a
17
27
23
28

25
27
28
23

UTILITY GOLF TOOL

BACKGROUND OF THE INVENTION

1. Field of the Invention

The field of invention relates to gold tools, and more particularly a device for use in cleaning operations and turf repair operations associated with the game of golf, as well as a readily accessible golf marker.

2. Description of the Prior Art

The use of golfing tools is well known in the prior art. Conventionally, the tools have utilized various brushes and repair devices, but have been of an organization and structure lacking effectiveness for their intended purpose. For example, U.S. Pat. No. 2,857,608 to Schwartz sets forth the use of a mount including a tapered downwardly depending scraping blade with an associated bristle brush and further formed with a fixed shank extension with an opening for receiving a tether line for securement by a user. The Schwartz patent sets forth a conventional brush arrangement that is limited in efficiency in a cleaning operation, as the nature of bristles may tend to scratch a desired cleaning surface if too stiff and if too soft, render the brush arrangement somewhat ineffective.

U.S. Pat. No. 3,539,107 to Johnson sets forth a turf repair tool formed with a plurality of prongs reciprocatably received within an associated rectangular case for use in turf repair, as associated with the game of golf.

U.S. Pat. No. 4,464,072 to Norwell sets forth a cleaning device for golf clubs including a conventional bristle brush arrangement wherein a liquid container is associated with a brush to discharge a liquid in cooperation with the brush to assist in a cleaning operation, but of a relatively remote organization to that of the instant invention but of interest relative to the securement arrangement relative to a golf bag.

U.S. Pat. No. 4,535,987 to Dikoff sets forth a golf tool formed with a turf repair blade and an associated marker for use in a golf game, but fails to provide the novel and interfolding compact organization of the instant invention with a novel brush associated therewith particularly adapted for cleaning golf equipment.

U.S. Pat. No. 4,670,932 to Williams sets forth a portable scraping tool formed with a handle for scraping between cleats on a sole of a golf-type shoe.

As such, it may be appreciated there is a continuing need for a new and improved utility golf tool which addresses both the problems of compactness and portability as well as effectiveness in use of the tool and in this respect, the present invention substantially fulfills this need.

SUMMARY OF THE INVENTION

In view of the foregoing disadvantages inherent in the known types of golf tools now present in the prior art, the present invention provides an utility golf tool wherein the same includes a plurality of implements received within a plurality of compartments for selective use, desired. As such, the general purpose of the present invention, which will be described subsequently in greater detail, is to provide a new and improved utility golf tool which has all the advantages of the prior art golf tools and none of the disadvantages.

To attain this, the present invention comprises a utility golf tool including a spaced plurality of planar members with a medial and integrally formed rib longitudinally thereof to define an upper and lower compartment with an upper compartment including a knife and nail file and a lower compartment including a turf repair tool and a golf cleaning brush wherein the brush includes a plurality of spaced rows of bristles of alternating heights formed with spherical ends to minimize abrasion during a cleaning procedure. The tool is further formed with a magnetic golf ball marker interfitting in a recess within one of the surfaces of the planar members.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved utility golf tool which has all the advantages of the prior art golf tools and none of the disadvantages.

It is another object of the present invention to provide a new and improved utility golf tool which may be easily and efficiently manufactured and marketed.

It is a further object of the present invention to provide a new and improved utility golf tool which is of a durable and reliable construction.

An even further object of the present invention is to provide a new and improved utility golf tool which is susceptible of a low cost of manufacture with regard to both materials and labor, and which accordingly is then susceptible of low prices of sale to the consuming public, thereby making such utility golf tool economically available to the buying public.

Still yet another object of the present invention is to provide a new and improved utility golf tool which provides in the apparatuses and methods of the prior art some of the advantages thereof, while simultaneously overcoming some of the disadvantages normally associated therewith.

Still another object of the present invention is to provide a new and improved utility golf tool formed with a plurality of interfitting pivotally mounted implements received with upper and lower compartments of a golf tool and including a refined golf cleaning brush provided with spherical type alternating bristles of varying heights to effect a safe and effective cleaning of golf equipment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
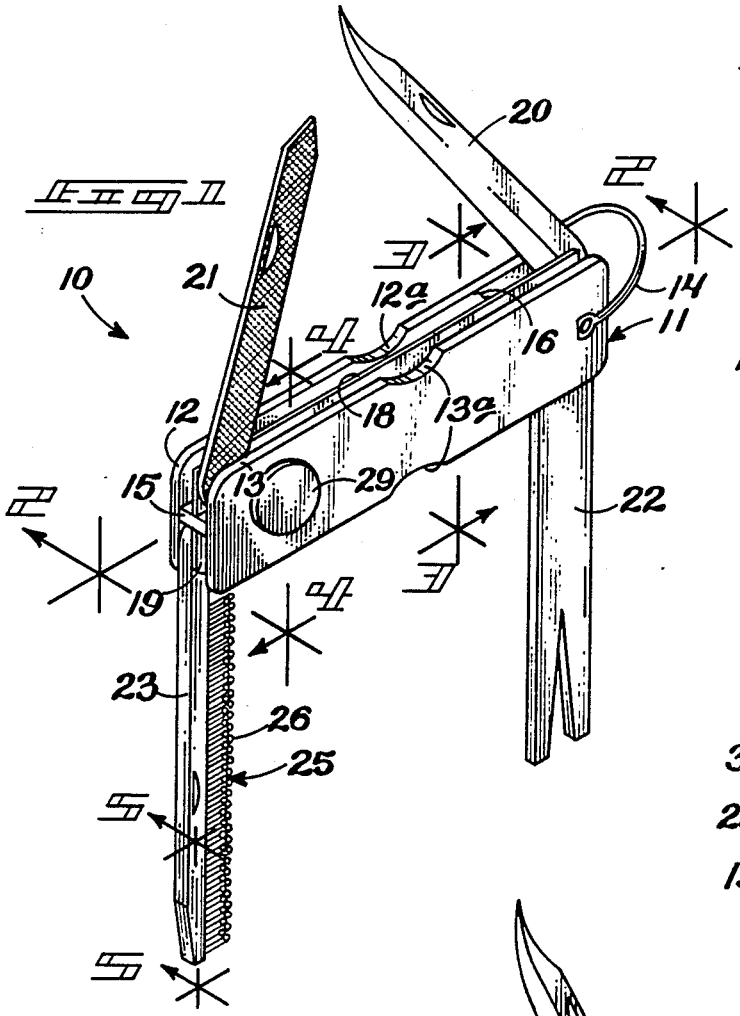
FIG. 1 is an isometric illustration of the instant invention.
Figure 3:
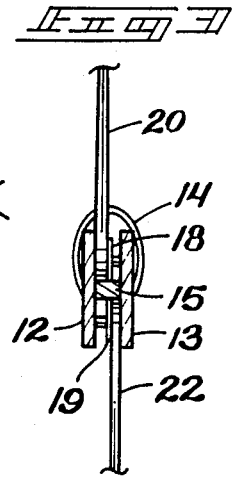
FIG. 3 is an orthographic view of the instant invention taken along the lines 3—3 of FIG. 1.
Figure 4:
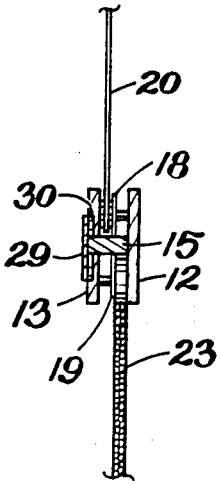
FIG. 4 is an orthographic view of the instant invention taken along the lines 4—4 of FIG. 1 in the direction indicated by the arrows.
Figure 2:
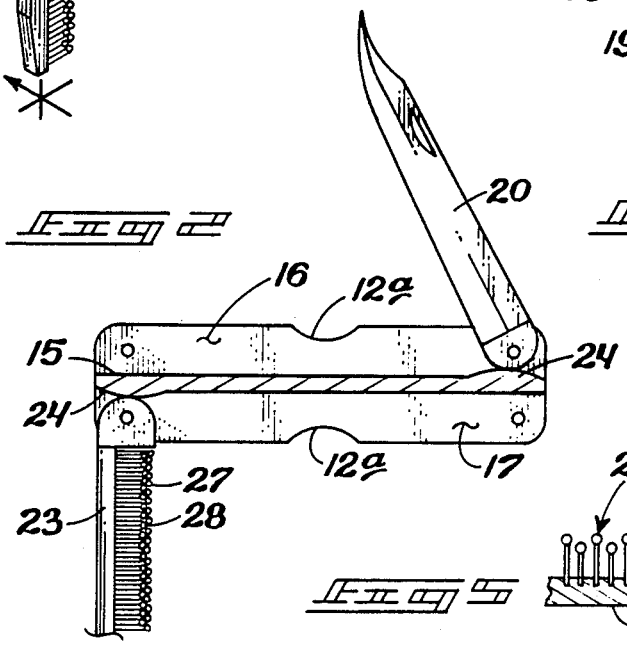
FIG. 2 is an orthographic view of the instant invention taken along the lines 2—2 of FIG. 1.
Figure 5:
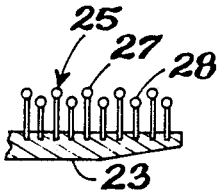
FIG. 5 is an orthographic view taken along the lines 5—5 of FIG. 1 in the direction indicated by the arrows.

With reference now to the drawings, and in particular to FIGS. 1 to 5 thereof, a new and improved utility golf tool embodying the principles and concepts of the present invention and generally designated by the reference numeral 10 will be described.

More specifically, it will be noted that the utility golf tool 10 essentially comprises a case 11 including a longitudinal first plate 12 parallel, fixed and spaced from a longitudinal second plate 13. A pivoted loop 14 is pivotally secured at a terminal end of each plate for securement to a chain or the like by a user. An orthogonal rib 15 is integrally secured between the plates 12 and 13 to maintain the plates at a predetermined spacing relative to each other and define an upper compartment 16 and a lower compartment 17. The upper compartment 16 is formed with an upper separator plate 18 wherein a comparable lower separator plate 19 is spaced within the lower compartment 17 to split the two compartments in equal longitudinal sections for positioning of associated blades, to be discussed below.

A utility cutting blade 20 is pivotally mounted for use in the upper compartment 16 to one side of upper separator plate 18 with a nail file 21 pivotally mounted on the other side of the separator plate 18 wherein the blades of the upper compartment are for convenience of a user and of utility and combination with the specialty tools of the lower compartment 17.

Lower compartment 17 includes a turf repair blade 22 formed with a pair of bifurcated terminal end portions for projection with an associated turf of a golfing outdoor form for replacement of divots resulting in a golfing situation.

A brush blade 23 is mounted in the lower compartment 17 parallel to the turf repair blade 22 on the other side of lower separator plate 19. The brush blade is formed with a matrix of bristles defining bristles of alternating length formed with spherical tips. The alternating lengths enable varying stiffness of bristles to encounter and clean the various grooves associated with golfing equipment, such as golf balls, golf clubs, shoes, and the like. The spherical tips ensure that the bristles will not be formed with sharp ends that will abrade and scratch surfaces with deleterious effects. For example, a golf ball that is cleaned and subsequently scratched, will be formed with a surface that may alter its flight path and similarly, a golf club head that is cleaned may be formed with scratches that will alter and abrade surfaces of golf balls. The bristles may be formed of stiff polymeric fibers or alternatively of stainless steel to provide bristles of corrosion resistant qualities.

It should be noted that the plates 12 and 13 are formed with aligned medially positioned finger recesses 12*a* and 13*a* respectively for enhanced securement by a user and further, that the various blades are formed with leaf springs 24 to assist in maintaining the blade in a closed or opened orientation with respect to the case 11.

Finally, a magnetic ball marker 29 is positioned within a complementary recess 30 for acceptance of the ball marker and positioning therein until use is desired.

The matrix of bristles of brush plate 23 are formed with long bristles 27 and short bristles 28 of alternating orientation relative to each other and to adjacent rows of the brush blade 23 to effect a desired pattern to effect thorough cleaning of golf equipment.

The manner of usage and operation of the present invention therefore should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A golf utility tool comprising, a case including a first plate in a spaced parallel aligned orientation to a second plate, a rib means integrally formed to interior facing surfaces of said first and second plates to define an upper compartment and a lower compartment, and said upper compartment including a first blade means and said lower compartment including a second blade means, and said second blade means including a bifurcated turf repair tool and a further blade defining a brush, said brush provided with a matrix of bristles of varying lengths for cleaning golf equipment, and wherein said bristles of varying lengths are of alternating lengths defining long bristles and short bristles, and wherein said bristles are formed with spherical tips to minimize abrasion of golf equipment during a cleaning procedure, and wherein said second plate is formed with a recess to receive a magnetic ball marker wherein said magnetic ball marker is positioned within said recess in a first position and removable from said recess in a second position for use in marking a golf ball on a golf course, and wherein said first and second blade means are provided with biasing means to bias said blades in a closed or open orientation relative to said case, and wherein said first and second plates are formed with aligned recesses medially of the edges of said first and second plates for enhanced securement by a user.

* * * * *